US006503292B2

(12) United States Patent
Klingensmith et al.

(10) Patent No.: US 6,503,292 B2
(45) Date of Patent: Jan. 7, 2003

(54) MOLTEN METAL TREATMENT FURNACE WITH LEVEL CONTROL AND METHOD

(75) Inventors: Marshall A. Klingensmith, New Kensington, PA (US); James R. Fields, Export, PA (US); Michael J. Kinosz, Apollo, PA (US)

(73) Assignee: Alcoa Inc., Pittsburgh, PA (US)

( * ) Notice: Subject to any disclaimer, the term of this patent is extended or adjusted under 35 U.S.C. 154(b) by 30 days.

(21) Appl. No.: 09/878,785

(22) Filed: Jun. 11, 2001

(65) Prior Publication Data

US 2002/0185790 A1 Dec. 12, 2002

(51) Int. Cl.[7] ..... C21D 11/00

(52) U.S. Cl. ..... 75/386; 75/387; 222/590; 222/594; 266/94

(58) Field of Search ..... 75/386, 387; 266/94; 222/590, 594

(56) References Cited

U.S. PATENT DOCUMENTS

| | | | | |
|---|---|---|---|---|
| 3,061,298 | A | 10/1962 | Yamazoe | 266/34 |
| 3,653,426 | A | 4/1972 | Groteke et al. | 164/257 |
| 3,771,588 | A | 11/1973 | Cavanagh | 164/337 |
| 3,844,453 | A | 10/1974 | Eickelberg | 222/399 |
| 4,844,425 | A | 7/1989 | Piras et al. | |
| 4,881,670 | A | 11/1989 | Yamaoka et al. | 222/590 |
| 4,967,827 | A | 11/1990 | Campbell | 164/134 |
| 5,020,778 | A | 6/1991 | Thibault et al. | 266/89 |
| 5,056,692 | A | 10/1991 | Wilford et al. | 222/590 |
| 5,395,094 | A | 3/1995 | Areaux | 266/233 |
| 5,411,240 | A | 5/1995 | Rapp et al. | 266/94 |
| 5,494,262 | A | 2/1996 | McLane et al. | 266/45 |
| 5,662,859 | A | 9/1997 | Noda | 266/94 |
| 5,700,422 | A | 12/1997 | Usui et al. | 266/94 |
| 5,725,043 | A | 3/1998 | Schaefer et al. | 164/119 |
| 6,290,900 | B1 * | 9/2001 | Hatano et al. | 266/94 |

* cited by examiner

*Primary Examiner*—Melvyn Andrews
(74) *Attorney, Agent, or Firm*—Webb Ziesenheim Logsdon Orkin & Hanson, P.C.

(57) ABSTRACT

A molten metal treatment furnace (10) with metal treatment and level control includes a heating chamber (12) for containing and heating a supply of molten metal (60), a pump (22) connected to the heating chamber (12), a molten metal treatment chamber (16, 18) located at the outlet of the pump (22), and a dosing chamber (40) located downstream and in fluid communication with the molten metal treatment chamber (16, 18). A trough (44) is connected to the dosing chamber (40) for supplying the molten metal (60) to a downstream process. A molten metal level sensor (66) is located in the dosing chamber (40). The pump (22) is a variable speed pump having a pump inlet (24) connected to the heating chamber (12) and configured to pump the molten metal (60) through the furnace (10) during operation. The molten metal level sensor (66) is connected to the pump (22) for providing a pump speed control signal to the pump (22). The molten metal level sensor (66) is configured to monitor the level of the molten metal (60) in the dosing chamber (40) and maintain a preset level of the molten metal (60) in the dosing chamber (40) by controlling the speed of the pump (22) with the pump speed control signal.

20 Claims, 2 Drawing Sheets

MOLTEN METAL TREATMENT FURNACE WITH LEVEL CONTROL AND METHOD

BACKGROUND OF THE INVENTION

1. Field of the Invention

The present invention relates to a molten metal treatment furnace that may be used for delivering molten metal to a downstream process such as a casting machine and, more particularly, a molten metal treatment furnace with level control.

2. Description of the Prior Art

There are many known arrangements and methods for moving molten metal between furnace vessels and, further, from furnace vessels to downstream devices such as casting machines. For example, U.S. Pat. No. 3,061,298 to Yamazoe discloses an apparatus for treating molten metal in which molten metal may be transferred between two holding vessels under the force of gravity. In the arrangement disclosed by the Yamazoe patent a first or upper vessel (e.g., ladle) is positioned above a second or lower vessel. The molten metal contained in the first ladle is transferred to the second ladle under the force of gravity. A combination electromagnetic recirculation pump and heating device is located between the two vessels for recirculating molten metal from the lower vessel to the upper vessel and for heating the molten metal as it passes through the recirculation pump.

U.S. Pat. No. 3,653,426 to Groteke et al. is directed to a furnace pouring and casting system that includes a holding furnace, a molten metal charging tower, and a molten metal pouring tower. The holding furnace is in fluid communication with both the charging tower and the pouring tower. When vacuum pressure is applied within the charging and pouring towers, molten metal flows from the holding furnace to the charging and pouring towers filling these chambers. The pouring tower is further connected to the mold cavity of a casting mold. In operation, after the charging and pouring towers are filled with molten metal, the charging tower is pressurized and forces molten metal into the pouring tower. The pouring tower, in turn, charges molten metal into the mold cavity under pressure.

U.S. Pat. No. 3,771,588 to Cavanagh discloses a molten metal injection casting arrangement for injecting molten metal into a casting mold. The apparatus disclosed by the Cavanagh patent includes a melting chamber that is in fluid communication with a holding chamber. The holding chamber is in fluid communication with the mold cavity of a casting mold. The holding chamber may be pressurized to force molten metal into the mold cavity of the casting mold under pressure. The melting chamber is used to replenish the supply of molten metal in the holding chamber.

U.S. Pat. No. 3,844,453 to Eickelberg discloses an apparatus for melting and pouring molten metal that includes a first vessel connected through a lower channel with a holding and pouring vessel (e.g., second vessel). The second vessel includes an outlet passage having an outlet opening for dosing molten metal from the second vessel. The second vessel is pressurized to dose the molten metal from the vessel. The first vessel is heated by a coreless induction heater. The lower channel between the two vessels is dimensioned so that molten metal freely flows between the vessels as the pressure is changed in the second vessel. The system disclosed by the Eickelberg patent is arranged such that as the second vessel is pressurized the first vessel remains substantially full of molten metal at all times for optimum operating efficiency of the induction heater heating the first vessel.

Often, a molten metal treatment step is included during the transfer of molten metal between furnace vessels or within the furnace vessel. For example, U.S. Pat. No. 4,881,670 to Yamaoka et al. discloses a holding furnace that includes means for treating the molten metal held within the holding furnace. The holding furnace includes a holding chamber for holding the molten metal at a predetermined temperature, a metal treatment chamber for cleaning the molten metal, and a melt supplying chamber configured to supply the molten metal to a downstream process. The metal treatment chamber includes a gas lance, a thermocouple, and upper and lower limit sensors. The gas lance may be used to inject inert gas into the molten metal to remove hydrogen and other gases from the molten metal.

U.S. Pat. No. 4,844,425 to Piras et al. discloses an apparatus for degassing and filtering molten aluminum alloys. The apparatus disclosed by the Piras et al. patent includes a vessel or container body that is divided into two chambers by an internal partitioning wall. A pair of degassing units is provided in one of the chambers for degassing the molten aluminum alloy contained within the first chamber. The partitioning wall separating the container body into two chambers includes a portion formed by a porous material, such as ceramic or graphite, for filtering the molten aluminum alloy passing from the first chamber to the second chamber.

U.S. Pat. No. 4,967,827 to Campbell discloses an apparatus for melting and casting metal in which molten metal is filtered as it is transferred from a melting vessel to a casting vessel. In the apparatus disclosed by the Campbell patent, the melting and casting vessels are connected by a horizontal launder. The melting and casting vessels are enclosed by a lid that includes a plurality of electric radiant heating elements. The lid further covers the launder connecting the melting and casting vessels. A filter box is located in the launder to filter the molten metal passing through the launder to the casting vessel.

It is also known in the art to recirculate molten metal within a molten metal holding/melting furnace to increase the thermal efficiency of the furnace or for other reasons. For example, U.S. Pat. No. 5,395,094 to Areaux discloses a metal melting furnace that is divided into three chambers. The metal melting furnace includes a main chamber in which the metal is melted and two forward chambers separated from the main chamber by a wall. The metal melting furnace disclosed by the Areaux patent includes a conveying conduit connecting the two front chambers for circulation of molten metal between these chambers to improve the overall thermal efficiency of the melting operations conducted within the metal melting furnace.

U.S. Pat. No. 5,411,240 to Rapp et al. discloses a two-chamber furnace for delivering molten metal to a casting machine. The two-chambers include a storage chamber and a removal chamber. An intermediate chamber is located between the storage chamber and the removal chamber. A pump is provided in the intermediate chamber for moving the molten metal from the storage chamber to the removal chamber. An overflow pipe is provided in the intermediate chamber and is used to recirculate a portion of the molten metal flowing into the intermediate chamber back to the storage chamber.

Further, it is known in the art to include means for controlling the level of molten metal contained in a molten metal holding/melting furnace or furnace vessel. For example, U.S. Pat. No. 5,662,859 to Noda discloses a constant molten metal surface level retaining furnace. The molten metal retaining furnace disclosed by the Noda patent includes a molten metal retaining chamber for storing the molten metal. The stored molten metal is intended for delivery to an injection sleeve of a die casting machine. A molten metal surface level control device is connected to the molten metal retaining chamber and is used to control the level of a float located in the molten metal retaining chamber. By controlling the level of the float within the molten metal retaining chamber, the overall level of the molten metal within the molten metal retaining chamber may be controlled.

U.S. Pat. No. 5,700,422 to Usui et al. discloses a molten metal supply device for supplying molten metal to an injection sleeve of a die casting machine. The molten metal supply device includes a holding furnace divided into a holding chamber and a supply chamber. The supply chamber is in fluid connection with the injection sleeve through a conduit. The holding chamber includes an immersion body that may be immersed in the molten metal in the holding chamber to displace and raise the overall level of molten metal in the holding chamber. As the level of molten metal rises to a predetermined level in the holding chamber, molten metal flows from the holding chamber to the supply chamber. A laser sensor is used to monitor the level of molten metal in the holding chamber and sends signals to a control unit, which is used to control the immersion body and, hence, the molten metal level in the holding chamber.

U.S. Pat. No. 5,056,692 to Wilford et al. discloses a dispensing apparatus for molten metal that includes a vessel, a container defining a chamber, and a support structure for supporting the container such that an open end of the container is immersed in the molten metal in the vessel. A vacuum pump is connected to the container to reduce the pressure in a headspace therein to draw molten metal into the chamber. A sensor is provided to sense the level of molten metal in the vessel and is connected to a regulating unit that is operable to regulate the pressure in the headspace of the container thereby regulating the volume of liquid in the container such that the level of molten metal in the vessel is maintained at a substantially constant level as molten metal is dispensed from the vessel.

The foregoing patents disclose different methods and arrangements for moving molten metal between furnace vessels and, in some cases, disclose treating molten metal within a furnace vessel or as the molten metal passes between furnace vessels. In addition, some of the foregoing patents disclose different methods and arrangements for the level control of molten metal within a furnace vessel. However, none of the foregoing discussed patents disclose both molten metal level control at the point of use (i.e., the point at which molten metal is delivered to a downstream process) and molten metal treatment in a single system.

SUMMARY OF THE INVENTION

In view of the foregoing, it is an object of the present invention to provide a furnace that includes both molten metal level control and metal treatment in a single system. It is another object of the present invention to provide a furnace that reduces the formation of metal oxides and the entrainment of gases in the molten metal as molten metal is transferred between different areas of the furnace. Further, it is an object of the present invention to provide a furnace that is suitable for use with molten aluminum alloys and is less likely to cause metal quality issues.

The above objects are accomplished with a molten metal treatment furnace with level control in accordance with the present invention. The molten metal treatment furnace with level control may be used to deliver molten metal to a downstream process such as a dosing furnace for a casting machine or other similar process. The furnace includes a heating chamber configured to contain and heat a supply of the molten metal. A variable speed pump is in fluid communication with the heating chamber. The pump has a pump inlet connected to the heating chamber and a pump outlet. The pump is configured to pump molten metal through the furnace during operation. A degassing chamber is in fluid communication with the pump through the pump outlet. The degassing chamber includes a degassing mechanism for removing gas and impurities from the molten metal flowing through the degassing chamber under the influence of the pump. A filter chamber is located downstream and in fluid communication with the degassing chamber. The filter chamber includes a molten metal filter for filtering the molten metal flowing through the filter chamber under the influence of the pump. A dosing chamber is located downstream and in fluid communication with the filter chamber. A molten metal level sensor is located in the dosing chamber and is connected to the pump for providing a pump speed control signal to the pump. The level sensor is configured to monitor the level of the molten metal in the dosing chamber and maintain a preset level of the molten metal in the dosing chamber by controlling the speed of the pump with the pump speed control signal. A trough is connected to the dosing chamber for supplying the molten metal to the downstream process. The trough for connecting the dosing chamber to the downstream process may be heated.

The pump may be a mechanical pump having a ceramic impeller located within a ceramic housing. The filter chamber may be in fluid communication with the heating chamber through a bypass conduit such that under the influence of the pump a portion of the molten metal flowing through the filter chamber recirculates to the heating chamber through the bypass conduit. The bypass conduit may connect the filter chamber to the heating chamber upstream of the molten metal filter. The degassing mechanism may be a rotary degassing mechanism. The trough, dosing chamber, and filter chamber may be enclosed by an electrical resistance-heated lid.

The degassing chamber and the filter chamber may be provided as a combined molten metal treatment chamber. The molten metal treatment chamber may be in fluid communication with the heating chamber through a bypass conduit such that under the influence of the pump a portion of the molten metal flowing through the molten metal treatment chamber recirculates to the heating chamber through the bypass conduit. The molten metal treatment chamber may include the degassing mechanism for removing gas and impurities from the molten metal flowing through the molten metal treatment chamber under the influence of the pump. The degassing mechanism may be a rotary degassing mechanism. The molten metal treatment chamber may further include a molten metal filter for filtering the molten metal flowing through the molten metal treatment chamber under the influence of the pump. The molten metal filter may be located downstream of the degassing mechanism in the molten metal treatment chamber.

The present invention is also a method of controlling the level of molten metal in a molten metal treatment furnace as generally described hereinabove. The method may comprise the steps of: pumping the molten metal from the heating chamber to the molten metal treatment chamber; treating the molten metal in the molten metal treatment chamber; pumping the molten metal to the dosing chamber; monitoring the level of the molten metal in the dosing chamber with the level sensor; providing the pump speed control signal to the pump to control the speed of the pump and maintain a preset level of the molten metal in the dosing chamber; and dosing the molten metal from the dosing chamber to the downstream process through the trough.

The method may further include the steps of recirculating a portion of the molten metal flowing through the molten metal treatment chamber to the heating chamber; degassing the molten metal in the molten metal treatment chamber; and filtering the molten metal in the molten metal treatment chamber. The step of filtering the molten metal in the molten metal treatment chamber may be performed after the step of degassing the molten metal in the molten metal treatment chamber.

Further details and advantages of the present invention will become apparent from the following detailed description read in conjunction with the drawings.

DETAILED DESCRIPTION OF THE PREFERRED EMBODIMENTS

Figure 1:
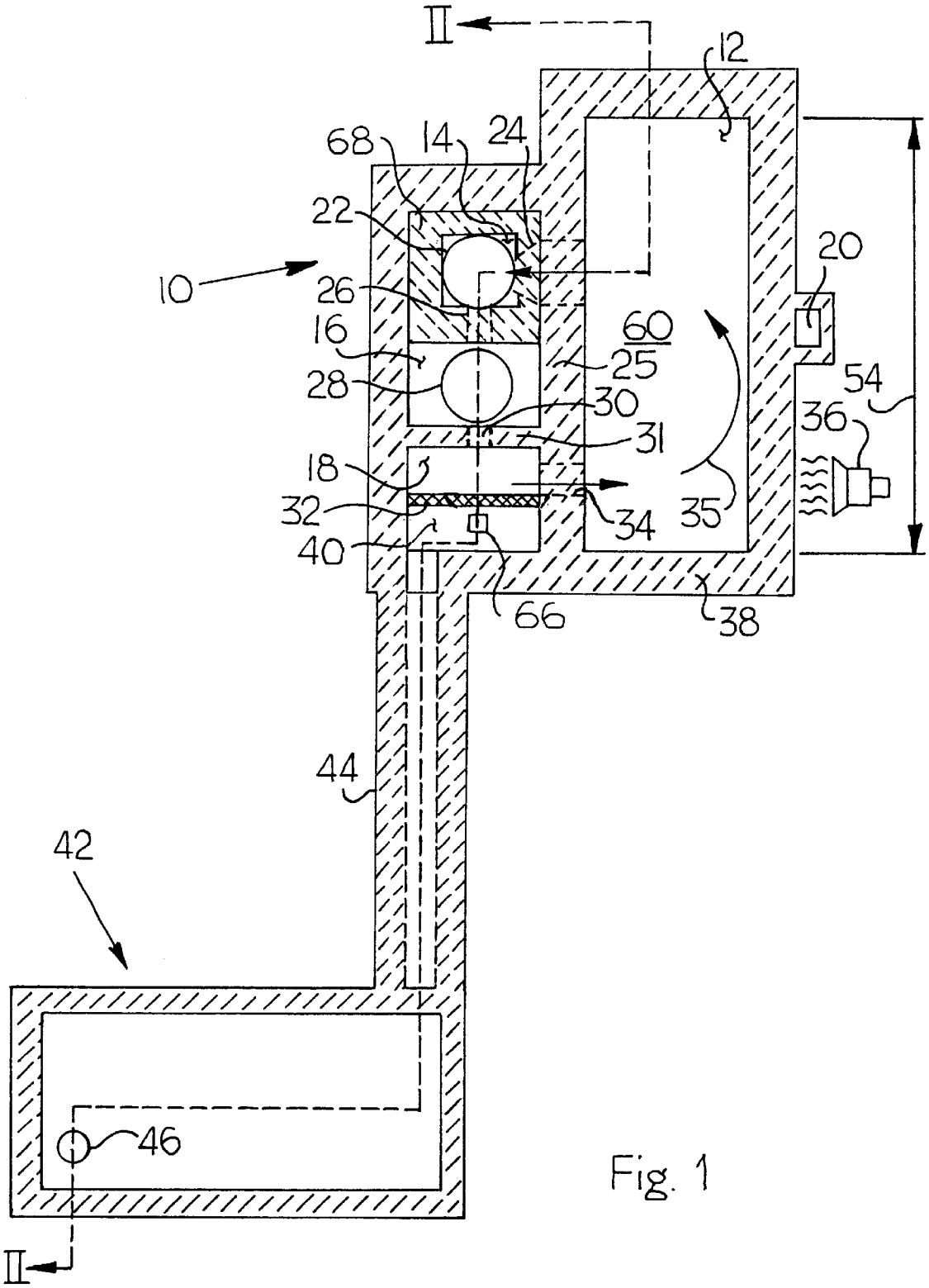
FIG. 1 is a schematic plan view of the molten metal treatment furnace with level control in accordance with the present invention.
Figure 2:
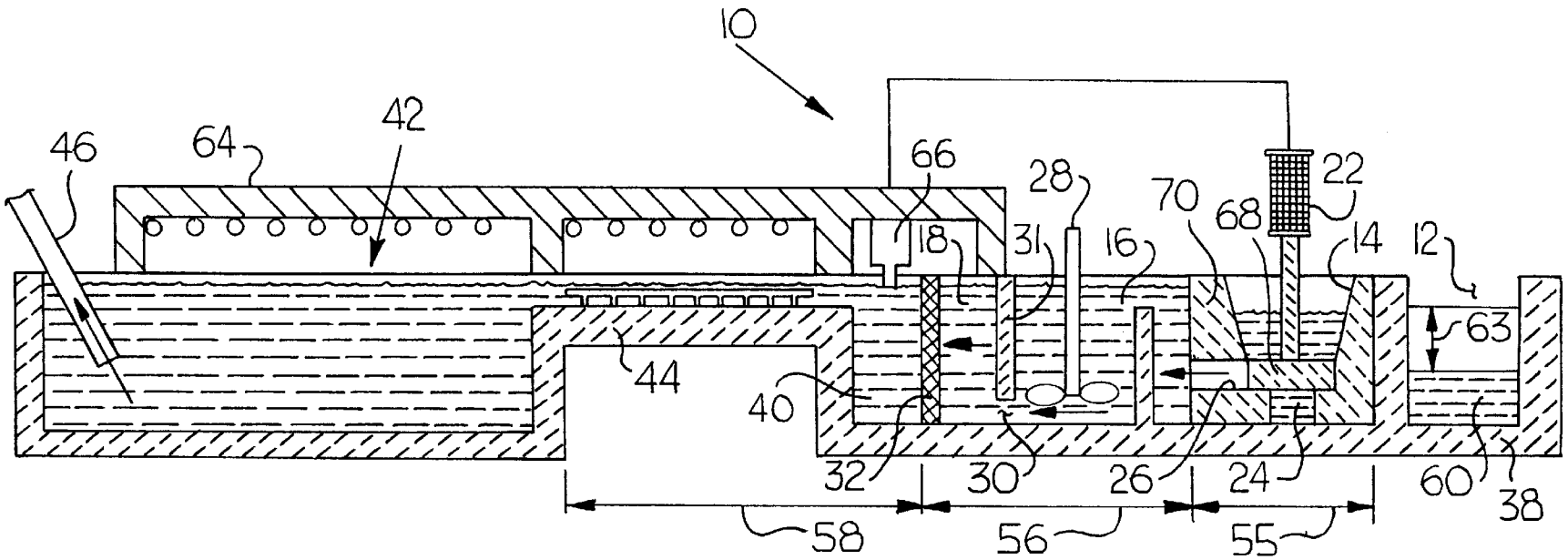
FIG. 2 is a schematic cross-sectional view of the molten metal treatment furnace with level control of FIG. 1 taken along lines II—II in FIG. 1.

Referring to FIGS. 1 and 2, a molten metal treatment furnace 10 in accordance with the present invention is shown schematically in a plan view and in a cross-sectional side view, respectively. The furnace 10 includes a heating chamber 12 for containing and/or melting a supply of molten metal. The furnace 10 further includes a pump chamber 14 located adjacent the heating chamber 12 and in fluid communication therewith. A molten metal degassing chamber 16 is located adjacent the pump chamber 14 and in fluid communication therewith. Further, the furnace 10 includes a molten metal filter chamber 18 located adjacent the degassing chamber 16 and in fluid communication with the degassing chamber 16 and the heating chamber 12. Thus, the heating chamber 12, the pump chamber 14, the degassing chamber 16, and the filter chamber 18 generally define the furnace 10. Solid or molten metal may be supplied to the heating chamber 12 through a filling well 20. The furnace 10 is preferably suitable for use with molten aluminum alloy.

The pump chamber 14 is located adjacent the heating chamber 12 and houses a molten metal pump 22 for circulating molten metal throughout the furnace 10. The pump 22 provides the necessary motive forces for moving molten metal between the heating chamber 12 and the other chambers of the furnace 10. The pump 22 preferably includes a ceramic impeller and ceramic housing and is preferably selected for use with molten aluminum alloys. The pump 22 may be a mechanical, gas lift, or electromechanical pump as examples.

An inlet 24 (e.g., pump inlet 24) to the pump 22 is in fluid communication with the heating chamber 12 through a common wall 25 that generally separates the heating chamber 12 from the pump chamber 14, the degassing chamber 16, and the filter chamber 18. An outlet 26 (e.g., pump outlet 26) of the pump 22 is in fluid communication with the degassing chamber 16. During operation of the pump 22, molten metal flows from the heating chamber 12 into the pump 22 through the pump inlet 24. The pump 22 then pumps molten metal into the degassing chamber 16 through the pump outlet 26.

The degassing chamber 16 houses a degassing mechanism 28. The degassing mechanism 28 is used to reduce the gas content of the molten metal in the degassing chamber 16 and, further, may be used to remove impurities from the molten metal passing through the degassing chamber 16. For example, when the molten metal is molten aluminum alloy or another similar metal, the degassing mechanism 28 may be used to reduce the hydrogen content of the molten aluminum alloy and, further, remove impurities from the molten aluminum alloy. The degassing mechanism 28 is preferably a rotary degassing mechanism. Suitable rotary degassing mechanisms for molten aluminum alloy applications include Alcoa Inc. rotary degasser model numbers R622 and R1022. The Alcoa Inc. R622 and R1022 devices are well-known and standard in the art.

For molten aluminum alloy applications, the rotary degassing mechanism 28 may use, for example, an inert gas, such as argon or nitrogen, to reduce the hydrogen content of the molten aluminum alloy flowing from the pump chamber 14 and passing through the degassing chamber 16 under the influence of the pump 22. Further, the rotary degassing mechanism 28 may use, for example, a mixture of 0.1 to 10% chlorine, or an equivalent, with a balance of argon or nitrogen to remove impurities from the molten aluminum alloy as the molten aluminum alloy passes through the degassing chamber 28. The cleaning/degassing techniques described hereinabove are often necessary when the molten metal is molten aluminum alloy, brass, bronze, copper, magnesium, or other similar metals having a low melting point, any of which may be used in the furnace 10 of the present invention.

The degassing chamber 16 is in fluid communication with the filter chamber 18 through an opening 30 extending through a separation wall 31 between these chambers. As will be discussed further hereinafter, the pump 22, when in operation, pumps molten metal through the degassing chamber 16. Thereafter, when molten metal is dosed from the furnace 10, molten metal flows under the force of the pump 22 and gravity from the degassing chamber 16 to the filter chamber 18 through the opening 30. The separation wall 31 may be omitted entirely thereby forming a "combined" degassing and filter chamber, which may be referred to as a "molten metal treatment chamber" as discussed hereinafter.

The filter chamber 18 includes a molten metal filter 32 for filtering the molten metal prior to passing or "dosing" the molten metal to a downstream process such as a die casting machine, a shape casting process, or a vacuum casting process. The molten metal filter 32 may be, for example, a Metaullics, Inc. No. 6 grit filter, which removes particles larger than 50–80 microns. A bypass conduit 34 extends through the common wall 25 separating the filter chamber 18 from the heating chamber 12. The bypass conduit 34 may include an adjustable bypass gate (not shown) for selectively allowing molten metal to flow from the filter chamber 18 to the heating chamber 12. The bypass conduit 34 enables internal circulation within the furnace 10 to ensure uniform temperature throughout the entire furnace 10. In particular, when molten metal is dosed from the furnace 10, the pump 22 and gravitational force induce the molten metal to flow to the downstream chambers, including the degassing chamber 16 and the filter chamber 18. The bypass conduit 34 provides a route for a portion of the molten metal entering the filter chamber 18 to recirculate to the heating chamber 12. The bypass conduit 34 preferably connects the filter chamber 28 to the heating chamber 12 upstream of the molten metal filter 32. Arrows 35 in FIG. 1 represent the internal circulation of molten metal within the furnace 10 provided by the bypass conduit 34.

The heating chamber 12 may be heated by an external heating device, such as a burner 36, located adjacent a sidewall or end wall of the heating chamber 12. The burner 36 may be configured to supply sufficient heat energy for melting metal (e.g., aluminum scrap) within the heating chamber 12 or, alternatively, the heat energy generally required to maintain a substantially constant molten metal temperature throughout the furnace 10.

The furnace 10 may be of standard construction and formed by an outer shell, which is preferably made of steel. The heating chamber 12, the pump chamber 14, the degassing chamber 16, and the filter chamber 18 are preferably formed by a layer of refractory material 38 lining the outer steel shell. The refractory material 38 is preferably selected for use with molten aluminum alloy and other similar containment difficult metals. The refractory material 38 is preferably also suitable for use with brass, bronze, copper, magnesium, zinc, and other similar metals having a low melting point. The refractory material 38 is used to form the common wall 25 separating the heating chamber 12 from the pump chamber 14, the degassing chamber 16, and the filter chamber 18. The refractory material 38 is further used to form the separation wall 31 separating the degassing chamber 16 and the filter chamber 18.

The furnace 10 further includes a dosing chamber 40 that is formed upstream of the molten metal filter 32 located within the filter chamber 18. The dosing chamber 40 is in fluid communication with, for example, a dosing furnace 42 of a casting machine or other downstream device. The dosing chamber 40 is in fluid communication with the dosing furnace 42 through a heated trough or launder 44. The dosing furnace 42 may include a siphon tube 46 that is used to deliver molten metal to a casting machine (not shown) or other device, as will be appreciated by those skilled in the art. The molten metal may be delivered to the downstream process by applying vacuum pressure to the siphon tube 46, which causes molten metal to flow upward into the siphon tube 46. The heated trough 44 preferably forms part of the furnace 10 of the present invention. The trough 44 may be heated by radiant heating elements, resistive type electrical heaters, oil or gas burners, or other heating methods known in the art.

The furnace 10 may generally be considered to be divided into four parts, which include: a molten metal melting or holding section 54 (shown in FIG. 1), a molten metal pumping section 55 located downstream of the melting section 54, a molten metal treatment section 56 located downstream of the pumping section 55, and a molten metal dosing section 58 located downstream of the treatment section 56. The melting/holding section 54 is defined by the heating chamber 12, which, as shown in FIG. 1, contains a supply or bath of molten metal 60 such as molten aluminum alloy. As will be discussed further hereinafter, the level of molten metal 60 in the heating chamber 12 will fluctuate as a result of the action of the pump 22 to resupply the molten metal 60 removed from the dosing chamber 40, and the solid or molten metal 60 added to the heating chamber 12 via the filling well 20 from an external source. Arrow 63 in FIG. 2 is provided to denote a representative amount the molten metal 60 in the heating chamber 12 may fluctuate as a result of these factors.

The molten metal pumping section 55 is defined by the pump chamber 14 and the pump 22 housed therein. The molten metal treatment section 56 is generally defined by the degassing chamber 16 and filter chamber 18. The degassing mechanism 28 and the molten metal filter 32 comprise the molten metal treatment equipment used in the molten metal treatment section 56. As discussed previously, the degassing chamber 16 and the filter chamber 18 may be formed as a single, "combined" molten metal treatment chamber by removing the separation wall 31 dividing these chambers. Such a "combined" molten metal treatment chamber would include one or both of the degassing mechanism 28 and the molten metal filter 32 for treating the molten metal entering this chamber from the molten metal pumping section 55.

The dosing section 58 is defined by the dosing chamber 40 and the heated trough 44 connected to, for example, the dosing furnace 42 of a casting machine (not shown). As discussed further hereinafter, the level of the molten metal 60 in the dosing chamber 40 will generally be maintained at a substantially constant level during operation of the furnace 10 while a level 63 of the molten metal 60 in the heating chamber 12 fluctuates. As shown in FIG. 2, the dosing section 58 and a portion of the treatment section 56 are enclosed by a heated lid 64. In FIG. 2, only the dosing section 58 and filter chamber 18 of the treatment section 56 are shown enclosed by the heated lid 64. However, it will be appreciated that the heated lid 64 may be extended to cover the other chambers of the furnace 10. The heated lid 64 is preferably an electrical resistance-heated lid. The heated lid 64 may be replaced by other molten metal heating devices, such as immersion heaters or radiant energy heaters, as will be appreciated by those skilled in the art.

A molten metal level sensor 66 is preferably located in the dosing chamber 40. The molten metal level sensor 66 is connected to the pump 22. Preferably, the pump 22 is a variable speed pump 22 that may be controlled by the molten metal level sensor 66. The molten metal level sensor 66 may also be located in the filter chamber 18 or the degassing chamber 16. The molten metal level sensor 66 is configured to continually monitor the level of molten metal in the dosing chamber 40 (or filter chamber 18 or degassing chamber 16) and provide a control signal to the pump 22 representative of the level of molten metal in the dosing chamber 40. The control signal (e.g., pump speed control signal) is used to control the speed of the pump 22 as will be discussed further hereinafter. The molten metal level sensor 66 operates in a similar manner whether provided in the dosing chamber 40, the filter chamber 18, or the degassing chamber 16. The molten metal level sensor 66 in combination with the pump 22 maintains a substantially constant level of the molten metal 60 in the dosing chamber 40. During period when the molten metal 60 is not dosed from the furnace 10, the pump 22 operates at a constant rotating speed to maintain a steady level of the molten metal 60 in the downstream chambers, while recirculating a substantially fixed flow of the molten metal 60 back to the heating chamber 12 through the bypass conduit 34. During periods when the molten metal 60 is removed from the dosing chamber 40, the rotating speed of the pump 22 increases to maintain the prescribed or preset level of the molten metal 60 in the dosing chamber 40. During periods when additional solid or molten metal 60 is added to the heating chamber 12, the rotating speed of the pump 22 decreases to maintain the prescribed or preset level of the molten metal 60 in the dosing chamber 40. As shown in FIG. 2, the pump 22 includes a pump impeller 68 and housing 70, which are preferably made of a ceramic material.

With continued reference to FIGS. 1 and 2, operation of the furnace 10 will now be described with the molten metal 60 used in the furnace 10 being molten aluminum alloy as an example. The burner 36 is generally used to maintain the molten aluminum alloy 60 in the heating chamber 12 at approximately between 1200° F. and 1500° F. The pump 22 located in the pump chamber 14 is utilized to circulate the molten aluminum alloy 60 through the various chambers of the furnace 10 and recirculate a portion of the molten aluminum alloy 60 to the heating chamber 12. The pump 22 receives the molten aluminum alloy 60 through the pump inlet 24 and passes the molten aluminum alloy 60 to the degassing chamber 16 through the pump outlet 26. The molten aluminum alloy 60 received in the degassing chamber 16 may be degassed and treated to remove impurities by the rotary degassing mechanism 28. To degas the molten aluminum alloy 60, the degassing mechanism introduces argon or nitrogen into the molten aluminum alloy 60. If it is necessary or desirable to remove impurities from the molten aluminum alloy 60, a mixture of about 0.1 to 10% chlorine with a balance of argon or nitrogen may be introduced in the molten aluminum alloy 60 by the degassing mechanism 28. As stated previously, during periods when the molten metal 60 is not dosed from the furnace 10, the pump 22 operates at a substantially constant rotating speed to maintain a steady level of the molten metal 60 in the downstream chambers, while recirculating a substantially fixed flow of the molten metal 60 back to the heating chamber 12 through the bypass conduit 34. During periods when the molten metal 60 is removed from the dosing chamber 40, the rotating speed of the pump 22 increases to maintain the prescribed or preset level of the molten metal 60 in the dosing chamber 40.

As the molten aluminum alloy 60 is dosed from the furnace 10, the rotational speed of the pump 22 increases to induce the molten aluminum alloy 60 to flow from the degassing chamber 16 to the filter chamber 18. The molten metal filter 32 located within the filter chamber 18 filters the molten aluminum alloy 60. From the filter chamber 18, the molten aluminum alloy 60 is passed to the dosing chamber 40 where it may be continuously dosed to a downstream process through the trough 44, while the level of the molten aluminum alloy 60 in the dosing chamber 40 remains substantially constant under the action of the pump 22.

As stated, the molten aluminum alloy 60 is passed to the downstream process through the heated trough 44. As shown in FIG. 2, the trough 44 may be, for example, connected to the dosing furnace 42 of a casting machine (not shown). The dosing furnace 42 may be connected to the casting machine through the siphon tube 46. The molten aluminum alloy 60 may be induced to flow up the siphon tube 46 by applying vacuum pressure to the siphon tube 46 or by other ways customary in the art.

The present invention enables a constant level of the molten aluminum alloy 60 to be maintained in the dosing chamber 40 due to the interaction of the molten metal level sensor 66 and the variable speed pump 22 housed within the pump chamber 14. To accomplish the foregoing, the molten metal level sensor 66 continually monitors the level of molten aluminum alloy 60 in the dosing chamber 40. Based upon the measured level of the molten aluminum alloy 60 in the dosing chamber 40, the molten metal level sensor 66 sends an output signal, (e.g., the pump speed control signal) to the variable speed pump 22. The pump speed control signal adjusts the speed of the pump 22 to compensate for the changing level of the molten aluminum alloy 60 in the heating chamber 12. The speed change of the pump 22 is necessary to adjust the head difference between the relatively constant level of molten aluminum alloy 60 in the dosing chamber 40 and the fluctuating level of molten aluminum alloy 60 in the heating chamber 12. By controlling the speed of the pump 22, the level of molten aluminum alloy 60 in the dosing chamber 40 may be maintained at a substantially constant level while the level of molten aluminum alloy 60 in the heating chamber 12 fluctuates. The heating chamber 12 may be periodically filled with new solid or molten aluminum alloy from a central supply system through the filling well 20. A similar process is followed when the molten metal level sensor 66 is located within the filter chamber 18 or the degassing chamber 16 rather than the dosing chamber 40.

When the molten aluminum alloy 60 is not being dosed from the furnace 10, the pump 22 operates to maintain a set level of the molten aluminum alloy 60 in the downstream chambers including the degassing chamber 16, the filter chamber 18, and the dosing chamber 40. This "static" operating condition of the pump 22 maintains a substantially constant downstream level of the molten aluminum alloy 60. The molten metal level sensor 56 automatically speeds up the pump 22 when a dosing operation commences. When the dosing operation commences, the pump 22 is aided by the force of gravity to transfer the molten aluminum alloy 60 to the degassing chamber 16, the filter chamber 18, and the dosing chamber 40 because the volume and, hence, the level of the molten aluminum alloy 60 in these chambers decreases.

The maintenance of a constant level of molten metal in the dosing chamber 40 is advantageous because it yields consistency in providing the molten metal to a downstream. Further, since a constant level of molten metal is maintained in the dosing chamber 40 during dosing operations there is less chance of metal oxide formation occurring in the dosing chamber 40 because of a fluctuating level of molten metal. This translates into improved quality of the molten metal being delivered to a downstream process. Further, due to the recirculating flow provided by the bypass conduit 34 to the heating chamber 12, the temperature of the molten metal in the furnace 10 is held substantially constant.

The furnace 10 of the present invention provides other advantages over currently known molten metal treatment/holding arrangements. Because the variable speed pump 22 is controlled to maintain a constant level of the molten metal in the dosing chamber 40 during dosing and non-dosing operations, the overall inventory of molten metal in the dosing chamber 40 may be minimized. Thus, the overall size of the furnace 10 may be minimized. In addition, the amount of "wash" metal required to flush the furnace 10 during metal alloy changes is reduced. Therefore, metal alloy changes to the downstream process may be expedited. Furthermore, impurities in the molten metal circulating through the furnace 10 are concentrated in the heating chamber 12 rather than the dosing chamber 40, which is the point of use for the molten metal stored in the furnace 10.

While preferred embodiments of the present invention were described herein, various modifications and alterations of the present invention may be made without departing from the spirit and scope of the present invention.

We claim:

1. A molten metal treatment furnace with level control for delivering molten metal to a downstream process, comprising:

a heating chamber configured to contain and heat a supply of the molten metal;

a variable speed pump in fluid communication with the heating chamber, with the pump having a pump inlet connected to the heating chamber and having a pump outlet, and with the pump configured to pump the molten metal through the furnace during operation;

a molten metal treatment chamber in fluid communication with the pump through the pump outlet;

a dosing chamber located downstream and in fluid communication with the molten metal treatment chamber;

a molten metal level sensor located in the dosing chamber and connected to the pump for providing a pump speed control signal to the pump, with the level sensor configured to monitor the level of the molten metal in the dosing chamber and maintain a preset level of the molten metal in the dosing chamber by controlling the speed of the pump with the pump speed control signal; and a trough connected to the dosing chamber for supplying the molten metal to the downstream process.

2. The furnace of claim 1, wherein the pump is a mechanical pump having a ceramic impeller located within a ceramic housing.

3. The furnace of claim 1, wherein the molten metal treatment chamber is in fluid communication with the heating chamber through a bypass conduit such that under the influence of the pump a portion of the molten metal flowing through the molten metal treatment chamber recirculates to the heating chamber through the bypass conduit.

4. The furnace of claim 1, wherein the molten metal treatment chamber includes a degassing mechanism for removing gas and impurities from the molten metal flowing through the molten metal treatment chamber under the influence of the pump.

5. The furnace of claim 4, wherein the degassing mechanism is a rotary degassing mechanism.

6. The furnace of claim 1, wherein the molten metal treatment chamber includes a molten metal filter for filtering the molten metal flowing through the molten metal treatment chamber under the influence of the pump.

7. The furnace of claim 1, wherein the trough is heated.

8. The furnace of claim 1, wherein the molten metal treatment chamber includes a degassing mechanism for removing gas and impurities from the molten metal flowing through the molten metal treatment chamber under the influence of the pump, and wherein the molten metal treatment chamber further includes a molten metal filter downstream of the degassing mechanism for filtering the molten metal flowing through the molten metal treatment chamber under the influence of the pump.

9. A molten metal treatment furnace with level control for delivering molten metal to a downstream process, comprising:

a heating chamber configured to contain and heat a supply of the molten metal;

a variable speed pump in fluid communication with the heating chamber, with the pump having a pump inlet connected to the heating chamber and having a pump outlet, and with the pump configured to pump the molten metal through the furnace during operation;

a degassing chamber in fluid communication with the pump through the pump outlet and including a degassing mechanism for removing gas and impurities from the molten metal flowing through the degassing chamber under the influence of the pump;

a filter chamber located downstream and in fluid communication with the degassing chamber and including a molten metal filter for filtering the molten metal flowing through the filter chamber under the influence of the pump;

a dosing chamber located downstream and in fluid communication with the filter chamber;

a molten metal level sensor located in the dosing chamber and connected to the pump for providing a pump speed control signal to the pump, with the level sensor configured to monitor the level of the molten metal in the dosing chamber and maintain a preset level of the molten metal in the dosing treatment chamber by controlling the speed of the pump with the pump speed control signal; and a trough connected to the dosing chamber for supplying the molten metal to the downstream process.

10. The furnace of claim 9, wherein the pump is a mechanical pump having a ceramic impeller located within a ceramic housing.

11. The furnace of claim 9, wherein the filter chamber is in fluid communication with the heating chamber through a bypass conduit such that under the influence of the pump a portion of the molten metal flowing through the filter chamber recirculates to the heating chamber through the bypass conduit.

12. The furnace of claim 11, wherein the bypass conduit connects the filter chamber to the heating chamber upstream of the molten metal filter.

13. The furnace of claim 9, wherein the degassing mechanism is a rotary degassing mechanism.

14. The furnace of claim 9, wherein the trough is heated.

15. The furnace of claim 9, wherein the trough, dosing chamber, and filter chamber are enclosed by an electrical resistance-heated lid.

16. A method of controlling the level of molten metal in a molten metal treatment furnace, with the furnace comprising:

a heating chamber configured to contain and heat a supply of the molten metal;

a variable speed pump in fluid communication with the heating chamber, with the pump having a pump inlet connected to the heating chamber and having a pump outlet, and with the pump configured to pump the molten metal through the furnace during operation;

a molten metal treatment chamber in fluid communication with the pump through the pump outlet;

a dosing chamber located downstream and in fluid communication with the molten metal treatment chamber;

a molten metal level sensor located in the dosing chamber and connected to the pump for providing a pump speed control signal to the pump; and a trough connected to the dosing chamber for removing the molten metal from the dosing chamber, the method comprising the steps of:

pumping the molten metal from the heating chamber to the molten metal treatment chamber;

treating the molten metal in the molten metal treatment chamber;

pumping the molten metal to the dosing chamber;

monitoring the level of the molten metal in the dosing chamber with the level sensor;

providing the pump speed control signal to the pump to control the speed of the pump and maintain a preset level of the molten metal in the dosing chamber; and dosing the molten metal from the dosing chamber to the downstream process through the trough.

17. The method of claim 16, further comprising the step of recirculating a portion of the molten metal flowing through the molten metal treatment chamber to the heating chamber.

18. The method of claim 16, further comprising the step of degassing the molten metal in the molten metal treatment chamber.

19. The method of claim 16, further comprising the step of filtering the molten metal in the molten metal treatment chamber.

20. The method of claim 18, further comprising the step of filtering the molten metal in the molten metal treatment chamber after the step of degassing the molten metal in the molten metal treatment chamber.

* * * * *